US006170701B1

(12) United States Patent
Youn

(10) Patent No.: US 6,170,701 B1
(45) Date of Patent: Jan. 9, 2001

(54) PACK HOLDER FOR POSTCARDS AND ENVELOPES

(75) Inventor: Karp-Sik Youn, Suwon (KR)

(73) Assignee: SamSung Electronics Co., Ltd., Suwon (KR)

( * ) Notice: Under 35 U.S.C. 154(b), the term of this patent shall be extended for 0 days.

(21) Appl. No.: 08/998,657

(22) Filed: Dec. 29, 1997

(30) Foreign Application Priority Data

Dec. 27, 1996 (KR) ..... 96-59059

(51) Int. Cl.[7] ..... B65H 1/00; B65H 3/34; B65H 3/52

(52) U.S. Cl. ..... 221/126; 271/171; 271/167; 271/121

(58) Field of Search ..... 271/109, 117, 271/121, 167, 171, 126

(56) References Cited

U.S. PATENT DOCUMENTS 4,343,461 * 8/1982 Tominori et al. .
4,406,447 * 9/1983 Fichte et al. .
4,457,507 * 7/1984 Ishikawa et al. .
5,069,434 * 12/1991 Sellers .
5,333,852 * 8/1994 Milillo et al. .
5,348,283 * 9/1994 Yanagi et al. .
5,364,087 * 11/1994 Schieck ..... 271/126
5,370,380 * 12/1994 Suzuki et al. .
5,384,631 * 1/1995 Matsunami ..... 355/308
5,480,247 * 1/1996 Saikawa et al. .
5,547,181 * 8/1996 Underwood .
5,611,528 * 3/1997 Nakamura et al. .
5,660,384 * 8/1997 Kovach et al. ..... 271/145

FOREIGN PATENT DOCUMENTS

405201557A * 8/1993 (JP) ..... 271/121

* cited by examiner

*Primary Examiner*—Christopher P. Ellis
*Assistant Examiner*—Kenneth W Bower
(74) *Attorney, Agent, or Firm*—Robert E. Bushnell, Esq.

(57) ABSTRACT

Disclosed is an paper feeding device or a pack holder capable of preventing noise or a misfeeding when printing envelopes or postcards. The pack holder can be adjusted to feed standard size paper or postcards and envelopes. A sliding plate is used when feeding postcards and envelopes so that the last postcard or envelope in the stack can be fed into the machine successfully. The sliding plate allows only one of the two feeding rollers to make contact with a friction pad during the feeding of postcards and envelopes.

16 Claims, 10 Drawing Sheets

VI-VI' section

PACK HOLDER FOR POSTCARDS AND ENVELOPES

CLAIM OF PRIORITY

This application makes reference to, incorporates the same herein, and claims all benefits accruing under 35 U.S.C. § 119 from an application for Paper Feeding Device earlier filed in the Korean Industrial Property Office on Dec. 27, 1996 and there duly assigned Serial No. 59059/1996

FIELD OF THE INVENTION

The present invention relates to a paper feeding device, and particularly to an improved paper feeding device capable of improving the image quality of a last sheet when printing a plurality of envelopes or postcards each having a size smaller than the standard size, i.e., A4 size, by means of a printing unit such as an image forming device.

DESCRIPTION OF THE RELATED ART

Office automation facilities include a receiving part which is called as a knockup plate or pack holder on which a plurality of documents or printable media are loaded so that the document and printable media can be fed to perform the scanning operation of the document or to print on the printable media; and a paper feeding device has a pickup device for feeding the document or the printable media loaded in the receiving part by one by one.

It is often necessary to load unusually small print media, such as envelopes and postcards for feeding into a machine one by one. Such small print media may require the use of only one feeding roller instead of two, to feed a sheet of print media into a machine. In particular, U.S. Pat. No. 5,069,434 for a Removable Dual Bin Envelope Feed Tray For An Image Reproduction Machine to Sellers, U.S. Pat. No. 5,348,283 for a Sheet Feeding Apparatus Having Sheet Separating Means With Adjustable Feeding Force to Yanagi et al, and U.S. Pat. No. 5,480,247 for a Sheet Supplying Apparatus to Saujawa et al each disclose paper feeding apparatus' that can accommodate the insertion of envelopes or postcards. I have not seen a paper feeding device that insures that the last envelope or postcard in a stack can be fed successfully into a machine. I have also not seen the use of a sliding plate on a paper feeding device for accommodating envelopes and postcards to successfully feed every last one envelope or postcard without noise or misfeeding.

SUMMARY OF THE INVENTION

Therefore, it is an object of the present invention to provide a paper feeding device capable of preventing a noise or a misfeeding, which prevents one friction pad from being contacted to its corresponding pickup device which are necessary for printing standard papers, even if the last sheet of envelopes or postcards is printed by the other friction pad.

It is also an object to provide a pack holder with a sliding plate that can be utilized whenever envelopes or postcards are to be printed on, the sliding plate being slid to cover one of the pair of friction pads thus allowing a third friction pad on the sliding plate to protrude further from the base of the pack holder than the other friction pad.

It is yet another object of the present invention to enable just one friction pad and one feeding roller to be contacted when feeding postcards and envelopes.

According to one aspect of the present invention, a paper feeding device includes: a first loading unit having a first plate and a pair of first friction pads established on the first plate facing a pair of feeding rollers, and loading a first paper; and a second loading unit having a second plate and a pair of second friction pads established on the second plate, and loading a second paper smaller than the first paper.

In the case that the second paper is supplied, the second loading unit is moved so that the second friction pad can be located at one of the first friction pads. Preferably, between a pair of the first friction pads on the first plate, a receiving groove for receiving the second loading unit is formed. Preferably, at one of side walls of the receiving groove corresponding to a pair of the first friction pads, an oblique section having a predetermined curvature is formed. Preferably, a slot is extended from the receiving groove to a part where the one of a pair of the first friction pads is formed across the oblique section. Preferably, the second plate is received by the receiving groove and the a bolt hole is formed at a part of the second plate corresponding to the slot. After a bolt is inserted through the bolt hole and the slot, the bolt and a nut are locked in the bolt hole. Preferably, at the backside of the second plate, a backside guiding groove having an area larger than the longitudinal section of the first friction pad. Preferably, the first paper is a A4 size paper and the second paper is an envelope or a post card having a size smaller than the A4 size.

According to another aspect of the present invention, a paper feeding device includes: at least two feeding rollers which are formed at a rotation shaft apart from each other; and friction pads which are formed corresponding to the feeding rollers at a knockup plate, wherein, the gap between each friction pad and each feeding roller is equally formed at a first feeding mode, and the gap between each friction pad and each feeding roller varies at a second feeding mode.

Preferably, the second feeding mode is a mode for feeding postcards or envelopes, and the gap between the feeding roller and the friction pad of one end in which the postcards and envelopes are inserted is formed smaller than the gap between the feeding roller and the friction pad of the other end.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
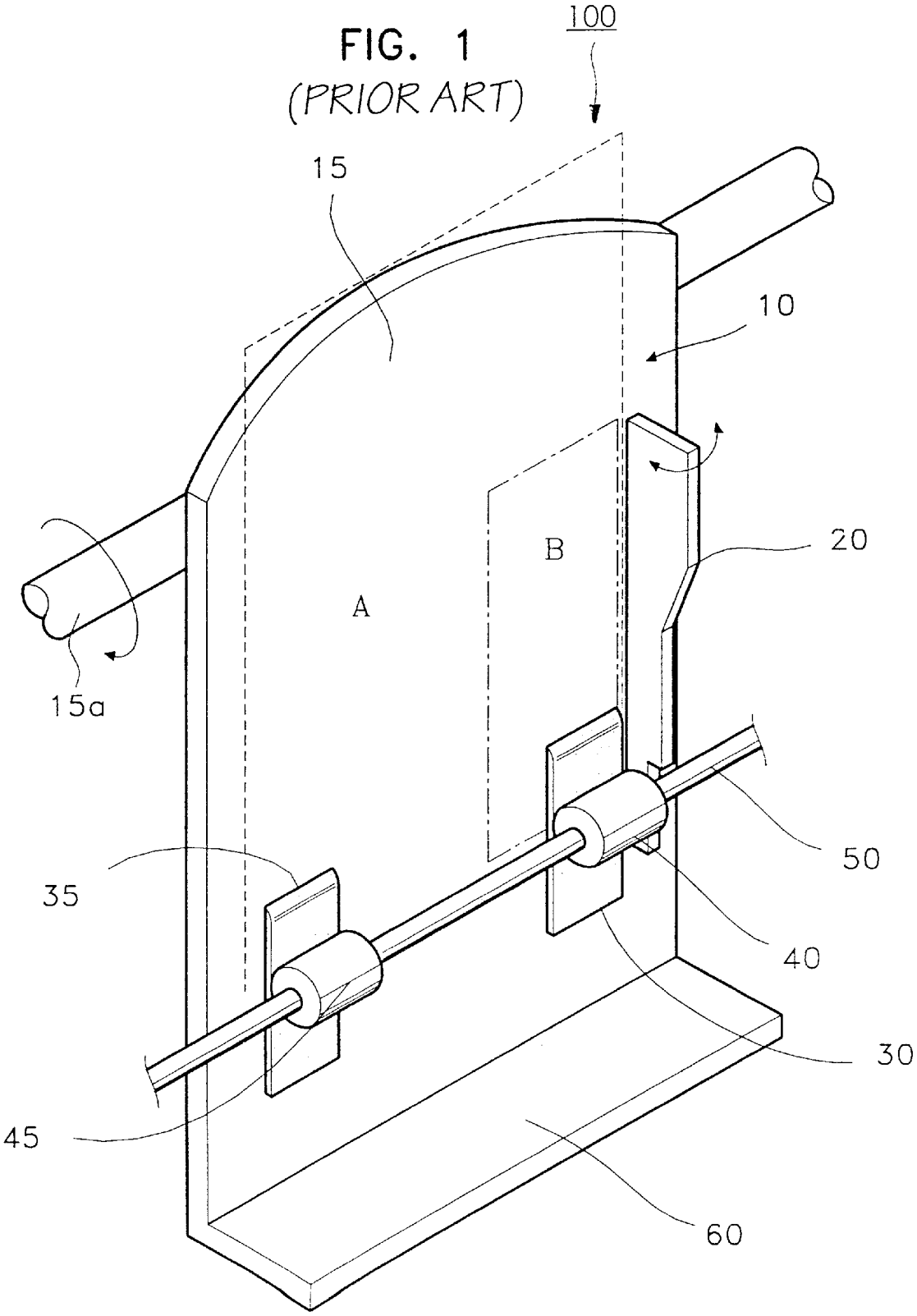
FIG. 1 (PRIOR ART)
FIG. 1 is a perspective view illustrating the conventional paper feeding device.

FIG. 1 is a perspective view illustrating an embodiment of the conventional paper feeding device. As shown in the drawing, the paper feeding device 100 includes a knockup plate (or pack holder) 10 which receives a plurality of standard paper A such as A4 size, postcards and envelopes B. The postcards and the envelopes have a size smaller than the standard paper. There is a pickup device for supplying the recording media by one by one.

The knockup plate 10 includes a base 15, a paper support 60, a guide 20 attached to the base 15 and friction pads 30 and 35. The base 15 is a flat plate of rectangular shape having a thin thickness. At the bottom of the base 15, the paper support 60 for supporting the standard paper A and the envelopes and the postcards B is provided. At the rear side of the upper part of the base 15, a plate rotating unit 15*a* is formed so that the documents can be loaded by rotating the knockup plate 10 centering around the base 15. A pair of the friction pads 30 and 35 made of a cork or a rubber are attached to the both sides which are apart from the central part of the base 15.

At the outer side of the right friction pad 30, a guide 20 is formed so that the envelopes or the postcards B can accurately be aligned at a preset position when the envelopes or the postcards B having a size smaller than the standard paper A is printed or transmitted. The guide 20 is rotated so that it is contacted to the base 15 so that is does not interrupt the printing operation when printing the standard paper A.

To pick up the standard papers A, the postcards or the envelopes B which are received by the knockup plate 10 having the above-described structure, a pickup device is established facing the right and left friction pads 30 and 35 on both sides. The pickup device includes pickup rollers 40 and 45 which are made of rubber corresponding to the right and left friction pads 30 and 35; and a rotation shaft 50 which transmits the rotary power to the pickup rollers 40 and 45.

Figure 2:
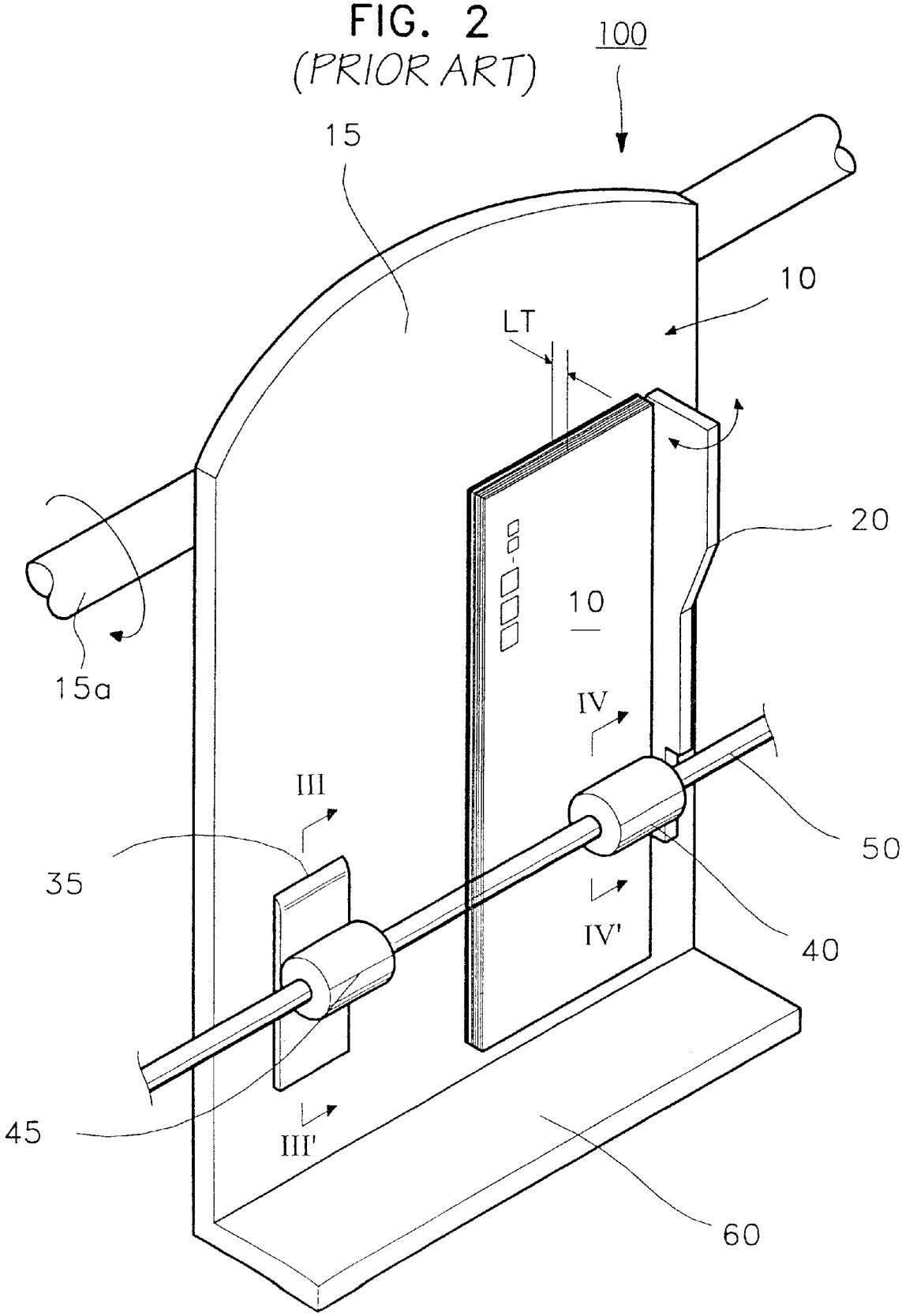
FIG. 2 (PRIOR ART)
FIG. 2 is a perspective view illustrating that envelopes or post cards are loaded in the conventional paper feeding device.

The base 15 of the knockup plate 10 is rotated by a predetermined angle by the plate rotating unit 15*a* so as to perform the printing and scanning operation on/from the standard paper A, the envelopes or the postcards B. By the rotated base 15, a predetermined gap is generated between the right and left pads 30 and 35 and the pickup rollers 40 and 45. As shown in FIG. 2, a plurality of the standard papers A, the envelopes or the postcards B are inserted into the gap and then they are received by the base 15.

The base 15 in which the standard paper A, the envelopes or the postcards B are inserted is restored to the original state, and thereby the uppermost sheet of the standard paper A, the envelope or the postcard B is closely contacted to the pickup rollers 40 and 45, and the last sheet is closely contacted to the right and left friction pads 30 and 35. After that, when the rotation shaft 50 is driven by a paper feeding signal, the pickup rollers 40 and 45 are rotated according to the driving of the rotation shaft 50, thereby supplying the uppermost sheet to a next process.

Figure 3:
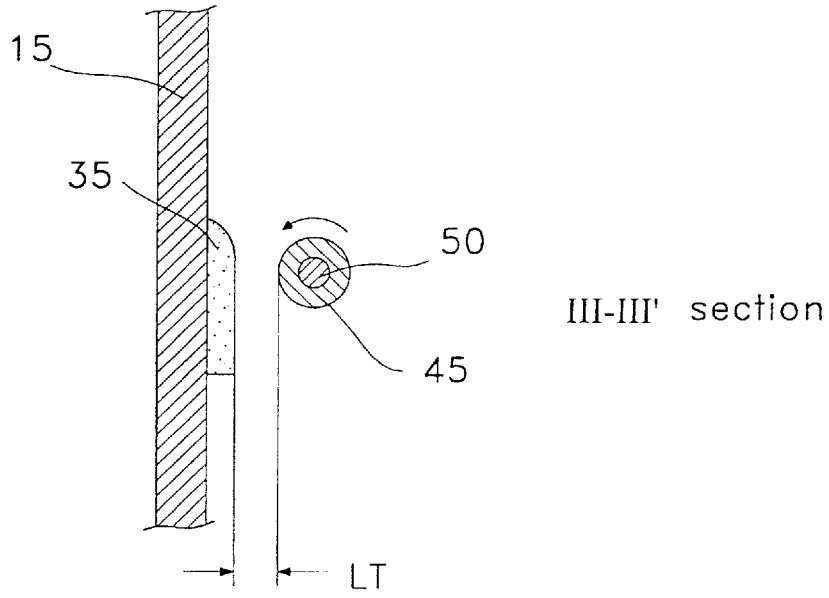
FIG. 3 (PRIOR ART)
FIG. 3 is a sectional view which is cut along a line III–III' of FIG. 2.
Figure 4:
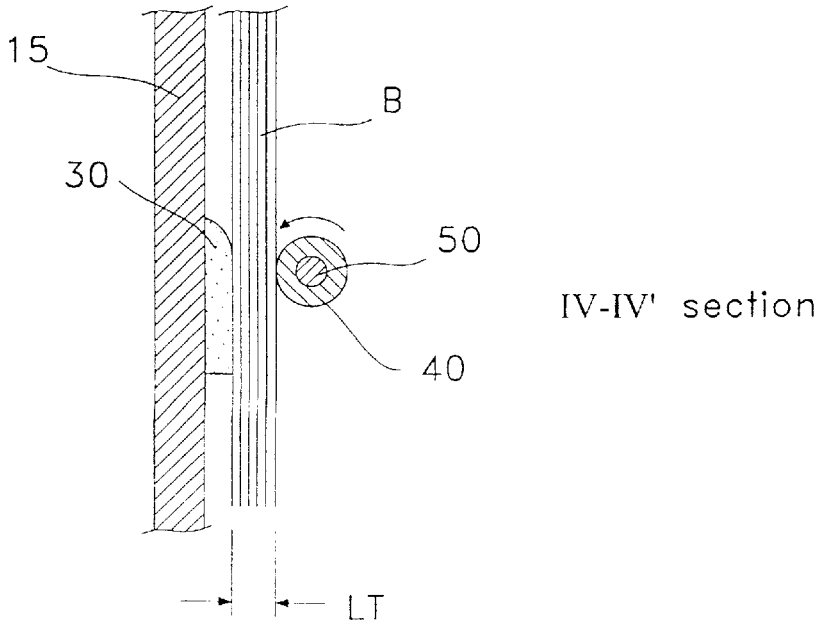
FIG. 4 (PRIOR ART)
FIG. 4 is a sectional view which is cut along a line IV–IV' of FIG. 2.

The conventional paper feeding apparatuses which supply two kinds of printable media each having a different size such as the standard paper A, the envelopes or the postcards B have following problems. The problems will be illustrated, with reference to FIGS. 3 and 4. FIG. 3 is a sectional view which is cut along a line III–III' of the FIG. 2, and FIG. 4 is a sectional view which is cut along a line IV–IV' of FIG. 2. As described above, a plurality of standard envelopes are arranged by the guide 20. The arranged envelopes B are closely contacted between the right friction pad 30 and the right pickup roller 40. If the thickness of a plurality of the envelopes B which are arranged is indicated as LT referring to the section which is cut along the line IV–IV' of FIG. 3, the gap between the right friction pad 30 and the right pickup roller 40 is the same as the thickness LT of the envelopes B. The base 15 in which the envelopes B are received is rotated by a predetermined angle by the plate rotating unit 15*a*. As shown in FIG. 3, the left friction pad 35 and the left pickup roller 45 are apart from each other as much as the width corresponding to the thickness LT of the envelopes B (here, LT>0).

As described, the envelopes B are loaded and the printing operation is performed. As the envelopes B are successively supplied, the thickness LT of the envelopes B decreases. As a result, the space between the left friction pad 35 and the left pickup roller 45 gradually decreases. When one or two envelopes B remain and thereby the thickness LT of the envelopes is smaller than 1 mm (0<LT<1 mm), the left friction pad 35 and the left pickup roller 45 are contacted each other. When printing the last sheet, the left friction pad 35 and the pickup roller 45 are completely contacted (here, LT=0). When the left friction pad 35 and the left pickup roller 45 are contacted each other, i.e., LT=0, in the case that the rotation shaft 50 starts to be rotated to print the last sheet, the friction between the left pickup roller 45 and the left friction pad 35 increases.

The paper feeding device 200 according to the present invention includes a first knockup plate (pack holder) 210 for loading the standard paper; a second knockup plate (slidable plate) 300 which is mounted on the first knockup plate so as to load a paper having a size smaller than the standard paper; and a pair of pickup units enabling the standard paper which is loaded in the first knockup plate, or the postcards or envelopes which are loaded in the second knockup plate to be fed.

The compartments of the paper feeding device will be explained, with reference to the drawings. The first knockup plate 210 includes a base 215; a pair of frictions pads 230 and 235 attached to the right and left sides of base 215 respectively; a second knockup plate receiving groove (recess) 270 having a rectangular shape which is formed to have a predetermined depth between the friction pads 230 and 235; a guide 220 which restricts the position of the envelopes or the postcards when performing the printing operation; a second knockup plate support 280 which guides the second knockup plate 300 which will be explained; and a paper support 260 which supports the standard paper, envelopes or postcards.

The base 215 is a rectangular shaped flat plate having a predetermined thickness which is composed of two long sides and two short sides. At one of the two short sides of the base 215, the paper support 260 is attached perpendicular to the base 215. Preferably, the part where the paper support 260 is attached can be the lower part of the base 215.

Moreover, a base rotating unit 215*a* is connected to the upper part of the base 215 so that the base 215 can be rotated, and the base 215 is rotated by a predetermined angle based on the base rotating unit 215*a*.

As illustrated, at lower parts apart from the center of the base 215 which is rotated by a predetermined angle based on the base rotating unit 215*a*, a pair of the right and left friction pads 230 and 235 are located. The right and left friction pads 230 and 235 are made of a cork or a rubber, and have thickness ST2. Moreover, the second knockup plate receiving groove 270 formed between the right and left friction pads 230 and 235 has a rectangular shape. Its length is larger than that of the right and left friction pads 230 and 235, and its depth is roughly half $ST_1$, the depth of recess 270 in base 215.

Figure 5:
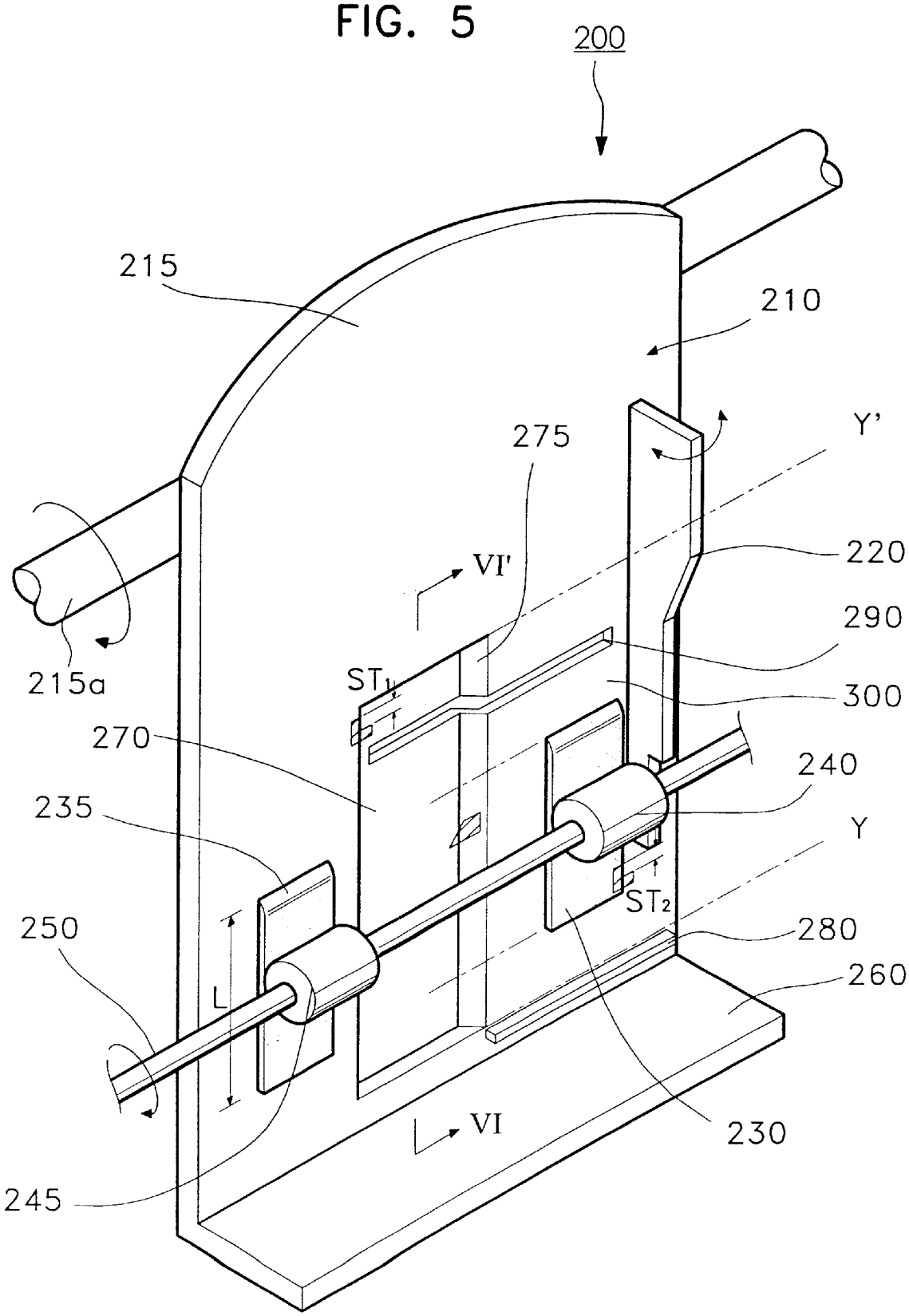
FIG. 5 is a perspective view illustrating a paper feeding device according to the present invention.

One side wall 275 placed in the direction of the right friction pad 230 out of four side walls of the second knockup plate receiving groove 270 has an angle larger than 90 degrees to the bottom of the second knockup plate receiving groove 270. In other words, as shown in FIG. 5, a slope is formed at the one side wall 275 and it is desirable to form the slope long enough.

A guiding slot 290 formed at the base 215 is a long part having an opening which is formed from the central part of the bottom of the second knockup plate receiving groove 270 to the front surface of the right friction pad 230 through the one side wall 275 at which a slope is formed. The second knockup plate support 280 is formed from the lower end of the side wall 275 at which the slope is formed of the second knockup plate receiving groove 270 to the long side of the first knockup plate 210, through the right friction pad 230. The second knockup plate support 280 is a bar shape having a predetermined thickness, whose thickness is the same as or lower than the right and left friction pads 230 and 235.

Figure 6:
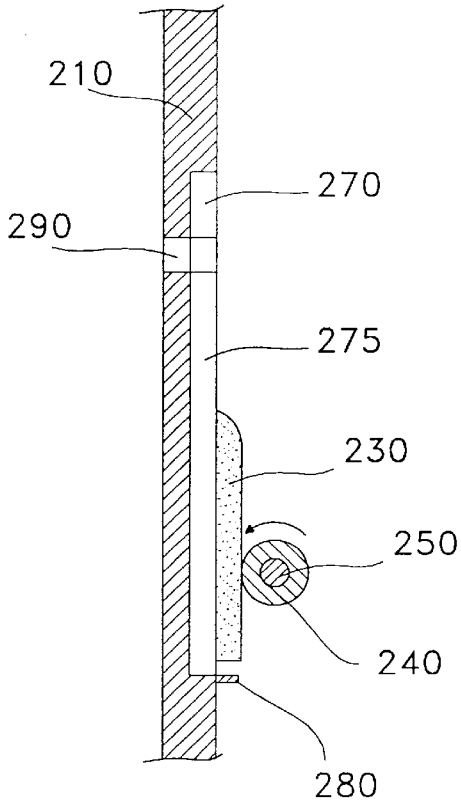
FIG. 6 is a sectional view which is cut along a line VI–VI' of FIG. 5.
Figure 7A:
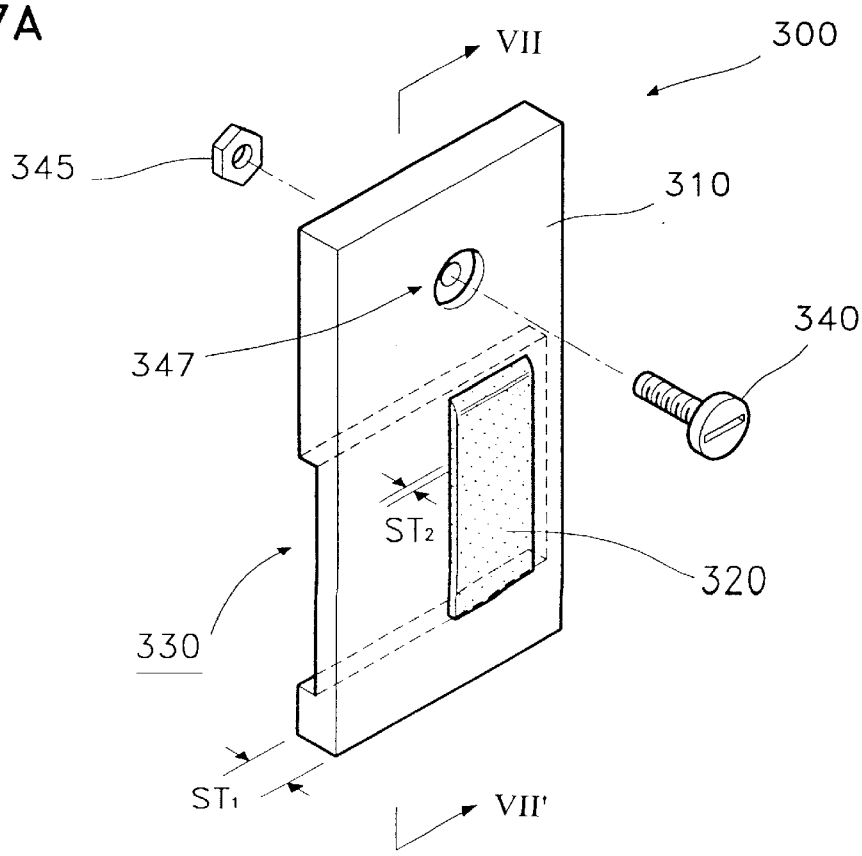
FIG. 7A is a perspective view illustrating a second knockup plate according to the present invention.
Figure 7B:
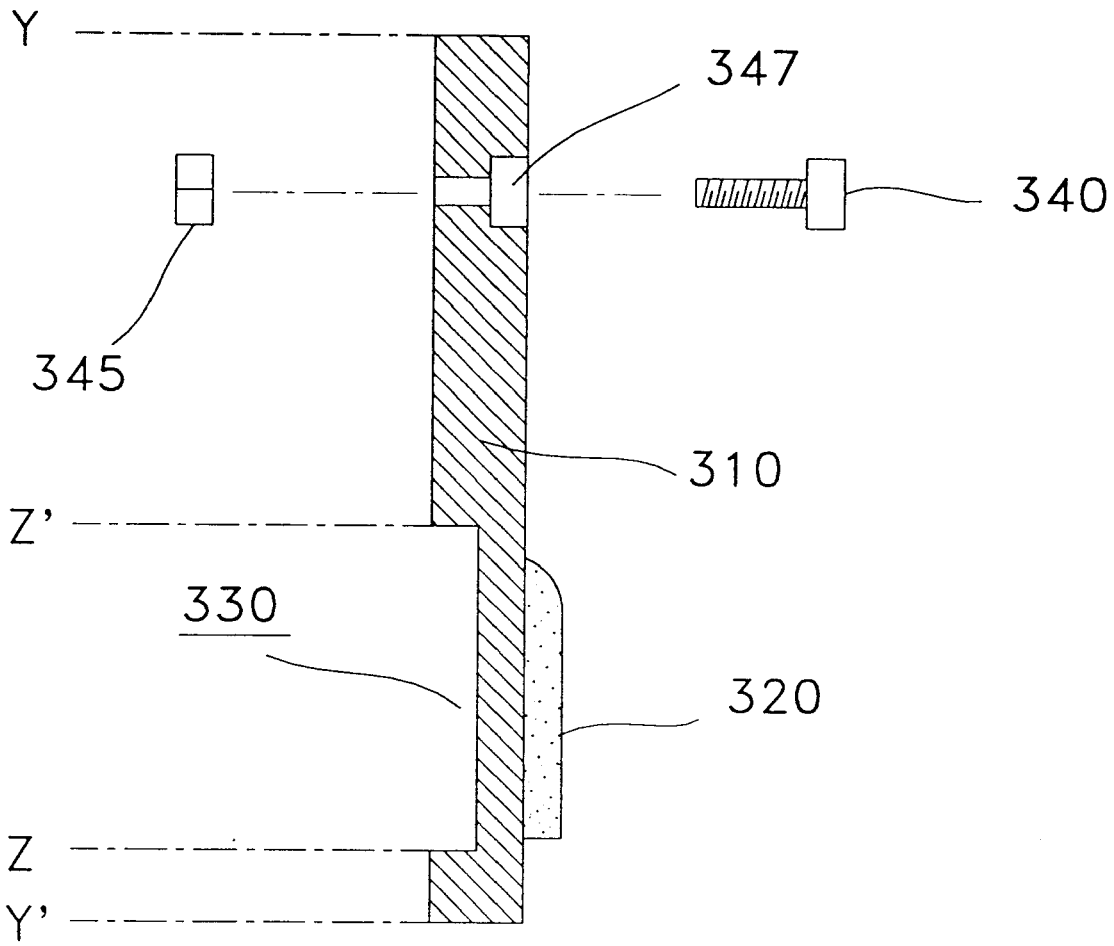
FIG. 7B is a sectional view which is cut along a line VII–VII" of FIG. 7A.

FIG. 6 is a sectional view in which the second knockup plate receiving groove 270 is cut along the line VI–VI'. As shown in the drawing, the thicknesses of the second knockup plate receiving groove 270, the guiding slot 290 which is formed long, the side wall at which the slope is formed, the right friction pad 230 and the pickup device contacted to the right friction pad 230 are clearly shown. At the second knockup plate receiving groove 270 in the first knockup plate 210, the second knockup plate 300 which is illustrated in FIGS. 7A and 7B is illustrated. The second knockup plate 300 includes a second knockup plate body 310; a guiding bolt hole 347; a second knockup plate friction pad 320; and a backside guiding groove 330. The second knockup plate body 310 is a rectangular flat plate and its length and width are slightly smaller than that of the second knockup plate receiving groove 270. Its thickness is the same as the depth $ST_1$, of the second knockup plate receiving groove 270.

Out of the second knockup plate body 310, the side which is contacted to the second knockup plate receiving groove 270 is defined as a backside of the body, and the other side is defined as a front side of the body. The second knockup plate friction pad 320 having the same thickness $ST_2$ as the right friction pad 230 of the first knockup plate 210 is attached to the front side. The position of the second knockup plate friction pad 320 is preferably set to be coincident with the pickup roller 240 when the second knockup plate body 310 is moved horizontally to the right. On the other hand, at the backside of the body 310, a backside guiding groove 330 having a depth slightly deeper than the thickness $ST_2$ of the right friction pad 230 of the first knockup plate 210 is formed. Moreover, the position of the backside guiding groove 330 is formed to receive the right friction pad 230, when the backside guiding groove 330 is moved to the right horizontally.

Referring to the sectional view of FIG. 7B, the second knock-up plate will be easily understood. The reference numeral 340 which is not illustrated is a guiding bolt including a screw head having a predetermined length, and the numeral 345 is a nut. The guiding bolt 340 is inserted into the guiding slot 290 of the first knockup plate 210 and it is fastened by the nut 345, thereby preventing the second knockup plate 300 from separating from the first knockup plate 210.

Figure 8A:
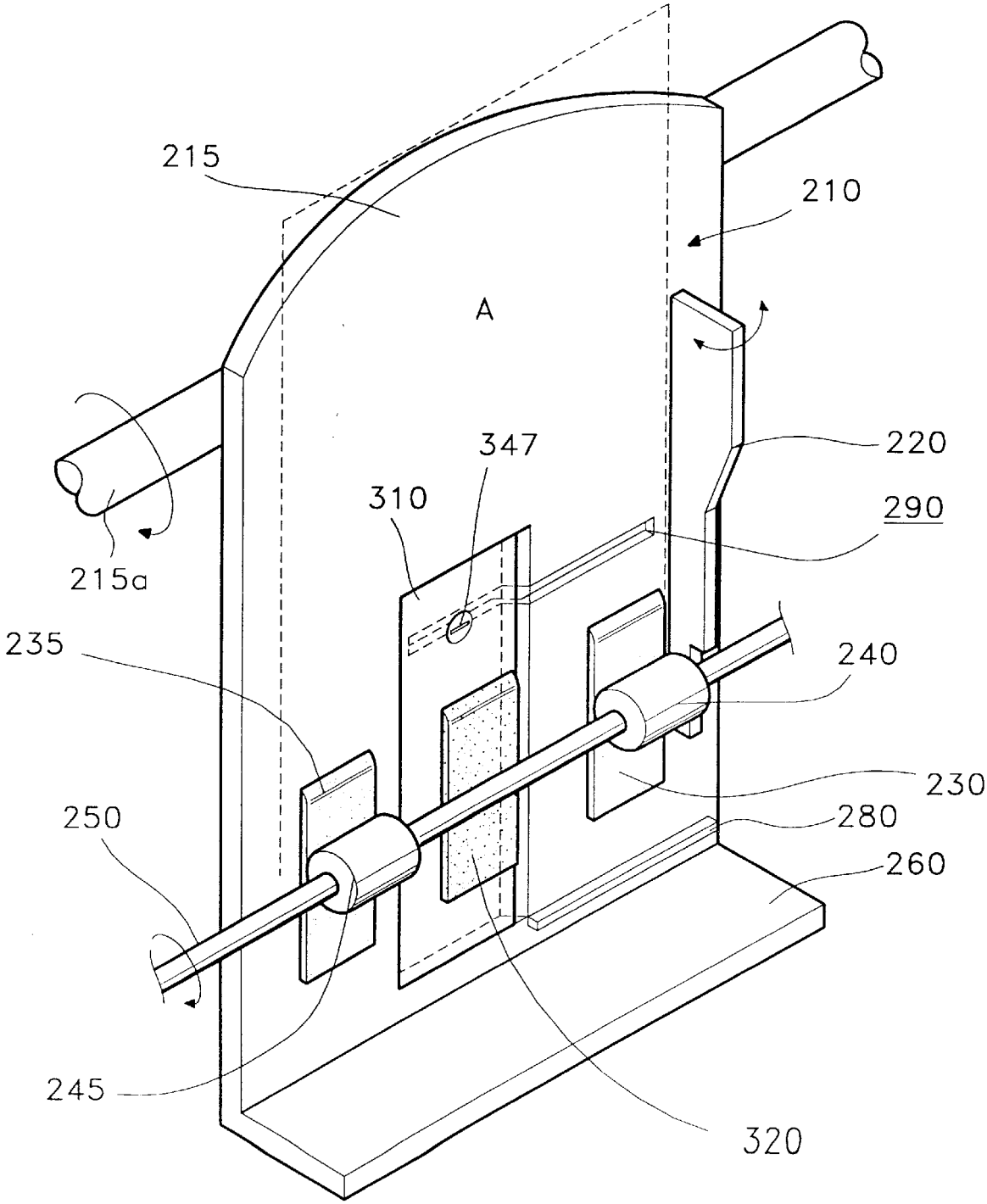
FIG. 8A is a perspective view illustrating that standard papers are loaded in a first knockup plate.
Figure 8B:
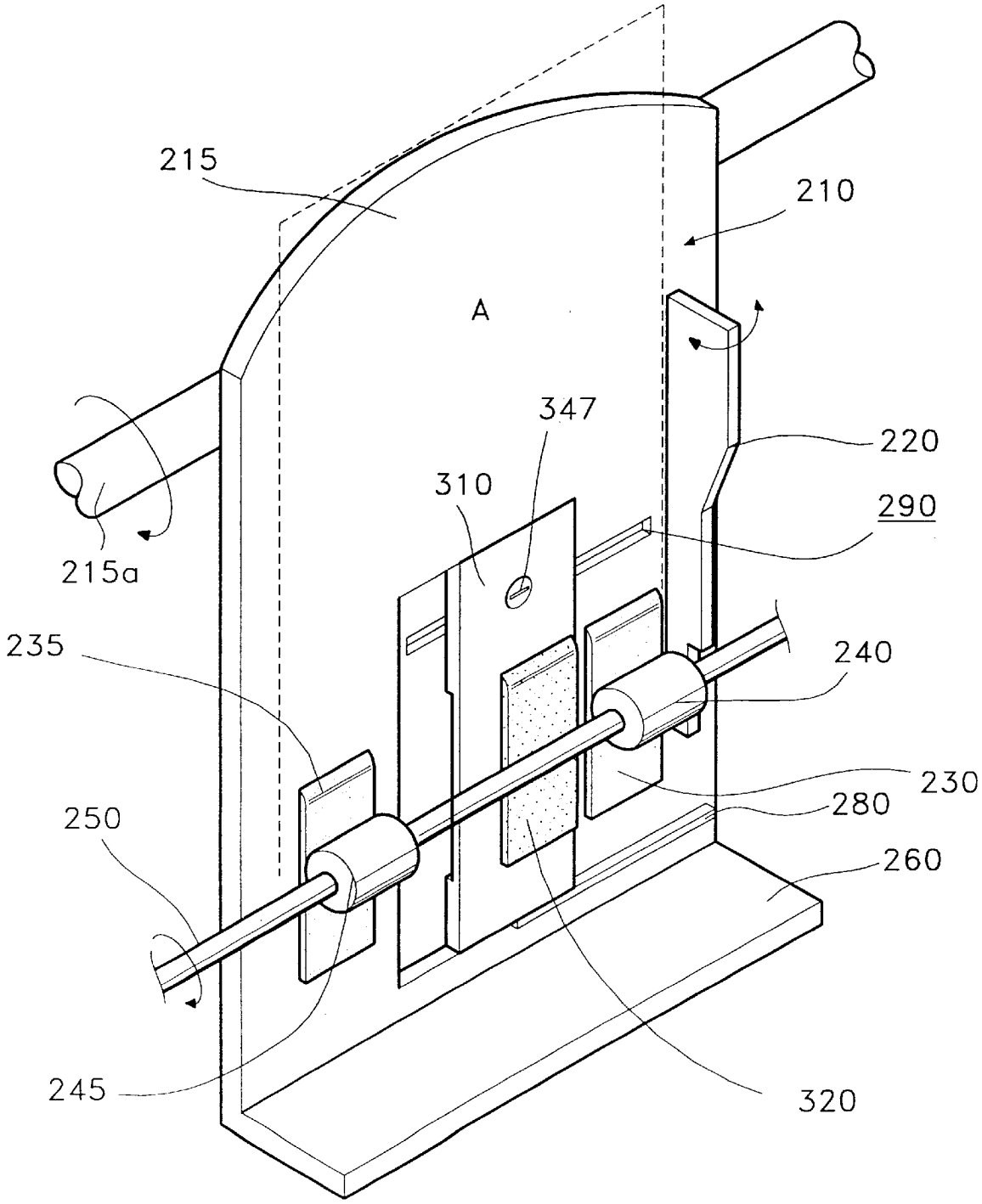
FIG. 8B is a view illustrating the operation of the paper feeding device according to the present invention.

The operation of the paper feeding device having the above-described structure according to the present invention will be explained, with reference to the drawings. FIG. 8A is a perspective view illustrating that the standard paper A is located at the paper feeding device according to the present invention, and FIG. 8B is a perspective view illustrating that the second knockup plate 300 moves towards the right for printing envelopes or postcards, each having a size smaller than the standard paper. Moreover, FIG. 8C is a perspective view illustrating that the preparation for printing the envelopes and postcards B is completed after second knockup plate is moved all the way over to the rightmost position.

As shown in FIG. 8A, when printing the standard paper A, the base 215 of the first knockup plate 210 is pulled toward the backside and it is rotated by a predetermined angle. After the standard paper is inserted between the right and left friction pads 230 and 235 and the right and left pickup rollers 240 and 245, the base 215 is restored to an original state and the standard paper is closely contacted between pickup rollers 240 and 245 and friction pads 230 and 235.

The second knockup plate body 310 has the same thickness as the recess 270 in base 215 of the first knockup plate 210. In addition, the right and left friction pads 230 and 235 and the second knockup plate friction pad 320 have the same thickness. As a result, friction pad 320 does not hinder the insertion of standard paper A.

Figure 8C:
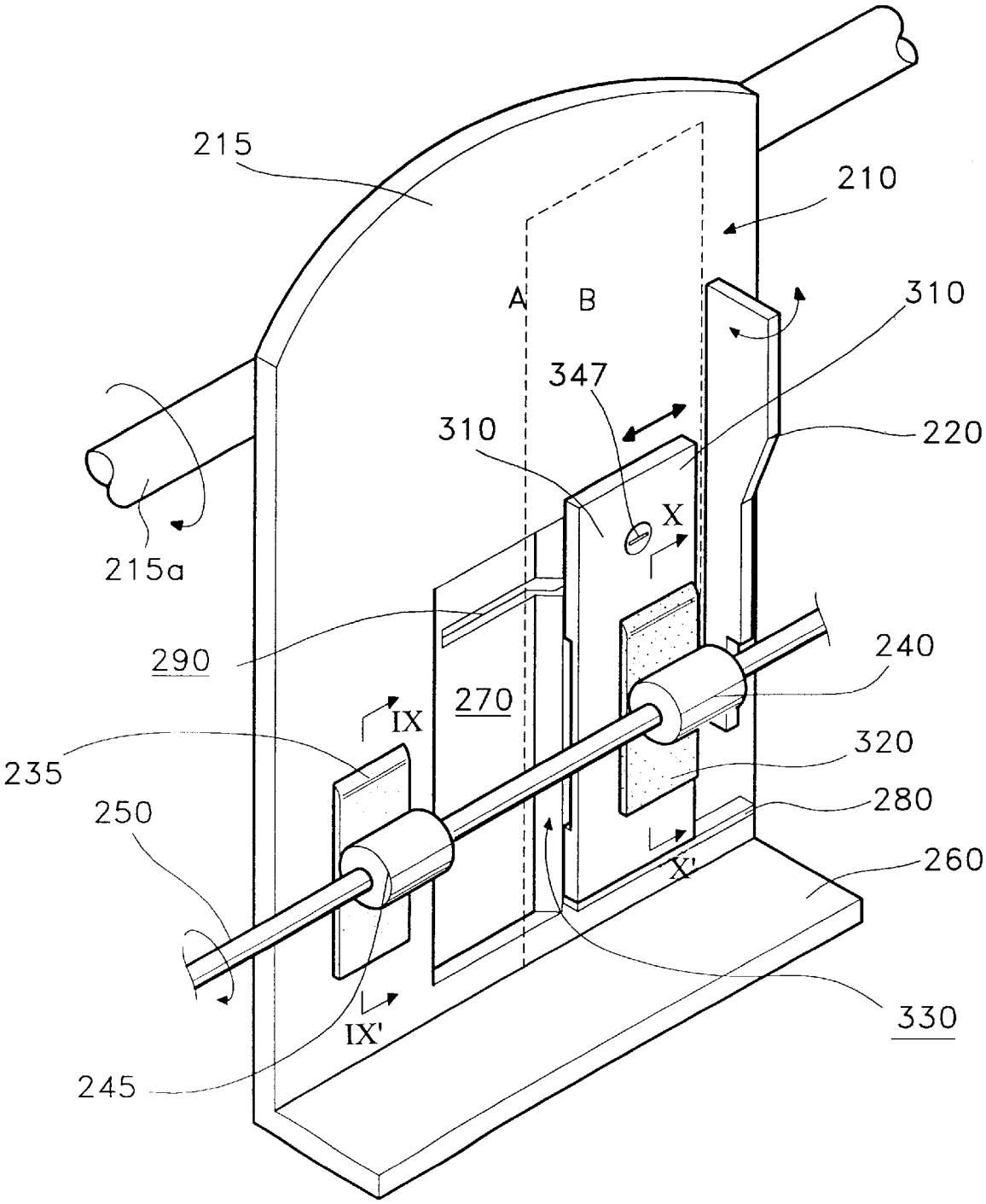
FIG. 8C is a perspective view illustrating that postcards or envelopes are loaded in the paper feeding device according to the present invention.

After completing the printing of the standard paper A, as shown in FIGS. 8B and 8C, when printing a plurality of envelopes and postcards B, the second knockup plate body 310 is simply moved to the right. At this time, the second knockup plate body 310 rides on sloped side wall 275 at which the slope is formed with the second knockup plate receiving groove 270, located at the front surface of the base 215 of the first knockup plate 210. Here, the second knockup plate body 310 is not separated from the first knockup plate 210 due to the guiding slot 290, guiding bolt 340 and nut 345. When the second knockup plate body 310 rises out of recess 270 in base 215, the backside of the second knockup plate body 310 is caught by the right friction pad 230 of the first knockup plate 210. To solve the problem, the backside guiding groove 330 is formed, and thereby the second knockup plate body 310 rises to the front surface of the base 215 of the first knockup plate 210 without being caught by the right friction pad 230.

At this time, the front surface of the second knockup plate friction pad 320 of the second knockup plate 310 is closely contacted to the right pickup roller 240. Under the state, after pulling the first knockup plate to the backside and rotating it by a predetermined angle, a plurality of the envelopes or postcards are filled. After that, the first knockup plate 210 is restored to the original state and thereby the envelopes and postcards are closely contacted between the right pickup roller 240 and the second knockup plate friction pad 320.

Figure 9A:
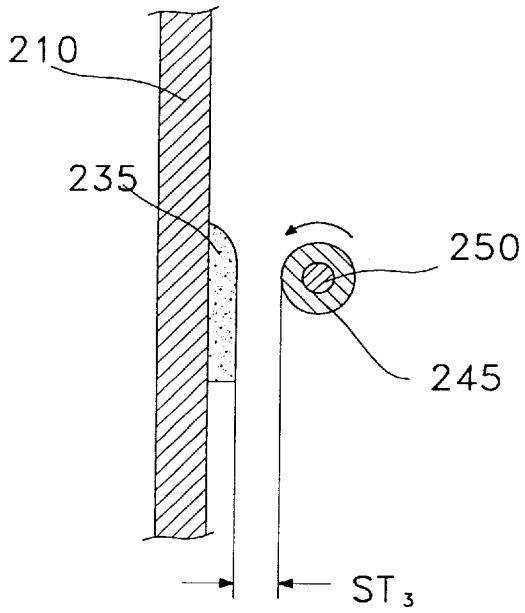
FIG. 9A is a sectional view which is cut along a line IX–IX' of FIG. 8C.
Figure 9B:
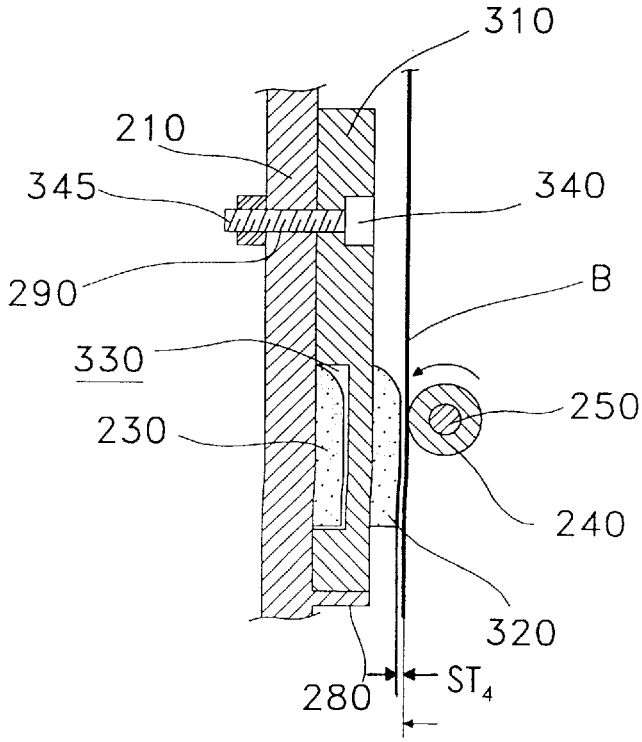
FIG. 9B is a sectional view which is cut along a line X–X' of FIG. 8C.

The relations between the left friction pad 235 and the left pickup roller 245 and between the second knockup plate friction pad 320 and the right pickup roller 240 are illustrated in detail in the sectional views of FIGS. 9A and 9B. FIG. 9B illustrates the last one or two sheets remaining after a plurality of the envelopes or postcards are already printed. As shown in the drawing, between the right pickup roller 240 and the second knockup plate friction pad 320, a gap $ST_4$ which is smaller than 1 mm is formed. Between the left friction pad 235 and the left pickup roller 245, a gap which is larger than 1 mm is formed. It is because the thickness ST, of the second knockup plate body 310 is added to the base 215 of the first knockup plate 210. This results in the second knockup plate friction pad 320 protruding further from first knockup plate 210 than left friction pad 235. In other words, though the gap of $ST_4$ becomes zero, the gap of $ST_3$ does not become zero. Though the envelopes or postcards to be printed is the last one or two sheets, the left friction pad 235 and the left pickup roller 245 are not contacted to each other, thereby removing the problems of any erroneous feeding, a noise, a waste of electric power, a falling off the feeding speed, etc.

Though an image forming device such as a printer is illustrated as an embodiment of the present invention, it can also be applied to the document scanning device such as a scanner.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A paper feeding device, comprising:

a first loading unit having a first plate;

a pair of friction pads being disposed on said first plate for loading a first paper;

a pair of feeding rollers located in operational relationship to said pair of friction pads;

a second loading unit having a third friction pad disposed thereon for loading a second paper; and a fastener mounting said second loading unit so that said third friction pad can be selectively positioned in operational relationship with one of said pair of feeding rollers.

2. The paper feeding device of claim 1, further comprised of:

said first loading unit being a rectangular shaped pack holder having a base, said base having a front side, a back side, a left side and a right side, a first of said pair of friction pads being disposed near said front side and said left side of said base, a second of said pair of friction pads being disposed near said front side and said fight side of said base;

a recess disposed on said base between said first and said second of said pair of friction pads; and a slidable plate, accommodated by said recess, said slidable plate movable to cover one of said pair of friction pads.

3. The paper feeding device of claim 2, further comprised of said slidable plate having a top side and a bottom side, said bottom side being adjacent to said base of said pack holder, and said top side having said third friction pad disposed thereon.

4. The paper feeding device of claim 3, further comprised of said slidable plate having a guiding groove formed on said bottom side to accommodate one of said pair of friction pads when moved to cover said one of said pair of friction pads.

5. The paper feeding device of claim 4, wherein a side of said recess nearest to said one of said pair of friction pads is sloped.

6. The paper feeding device of claim 5, further comprised of a guiding slot extending from said recess of said base to a side of said pack holder nearest to said one of said pair of friction pads, said guiding slot preventing said slidable plate from being detached from said base of said pack holder.

7. The paper feeding device of claim 6, further comprised of said slidable plate being rectangular.

8. The paper feeding device of claim 7, wherein when said slidable plate is moves from said recess and towards said side of said packholder nearest to said one of said pair of friction pads, said third friction pad makes contact with one of said pair of feeding rollers while said first friction pad does not make contact with the other of said pair of feeding rollers.

9. A pack holder device, comprising:

a base having a recess;

first and second spaced-apart feeding rollers positioned to feed paper from said pack holder;

a first friction pad in operational relationship with said first feeding roller;

a second friction pad in operational relationship with said second feeding roller;

a plate supporting both said first and said second friction pads in pressed relationship respectively against both said first and said second feeding rollers upon loading a first paper; and a sliding plate, disposed within said recess and covering one of said first and second friction pads and supporting a third friction pad in pressed relationship against one of said first and second feeding rollers corresponding to said covered friction pad when loading a second paper smaller than said first paper.

10. The pack holder device of claim 9, wherein said sliding plate has a top side and a bottom side, said bottom side faces said base of said pack holder, said top side having a friction pad disposed thereon, said friction pad can be moved into operational relationship with said second feeding roller.

11. The pack holder device of claim 10, wherein when said sliding plate is slid over said second friction pad, a gap is formed between first friction pad and said first friction roller.

12. The pack holder device of claim 11, further comprised of said sliding plate having a guiding groove on said bottom side to accommodate said second friction pad when said sliding plate is slid over said second friction pad.

13. The pack holder device of claim 12, wherein said base of said pack holder is perforated by a guiding slot accommodating attachment of said sliding plate to said pack holder and enabling said sliding plate to slide from said recess onto said second friction pad.

14. The pack holder device of claim 13, further comprised of said recess in said base having one sloped sidewall accommodating the sliding of said sliding plate from said recess to said second friction pad.

15. A method of loading a packholder with envelopes and postcards, comprising:

providing a base unit having a pair of friction pads and a pair of feeding rollers that act in cooperative relationship with said friction pads;

providing a sliding plate having a bottom side and a top side, said bottom side facing said base and a top side having a friction pad disposed thereon;

moving said sliding plate having said friction pad from between said pair of friction pads on said base to a position covering one of said pair of friction pads on said base so that said friction pad on said sliding plate acts in cooperative relationship with one of said pair of feeding rollers; and inserting envelopes and postcards between said friction pad on said top side of said sliding plate and said one of said pair of feeding rollers.

16. The method of claim 15, further comprising:

providing a base rotating unit allowing said base to rotate;

rotating said base about said base rotating unit;

inserting envelopes and postcards between said friction pad on said top side of said sliding plate and said one of said pair of feeding rollers; and rotating back said base about said base rotating unit.

* * * * *